United States Patent [19]

Taniguchi

[11] 4,428,209

[45] Jan. 31, 1984

[54] CARDING DRUM FOR HIGH PILE CIRCULAR KNITTING MACHINES

[75] Inventor: Kozo Taniguchi, Hyogo, Japan

[73] Assignee: Precision Fukuhara Works, Ltd., Kobe, Japan

[21] Appl. No.: 339,644

[22] Filed: Jan. 15, 1982

[30] Foreign Application Priority Data

Mar. 30, 1981 [JP] Japan ..... 56-45169[U]

[51] Int. Cl.[3] ..... D04B 9/14

[52] U.S. Cl. ..... 66/9 B; 19/114

[58] Field of Search ..... 19/112, 114, 98, 99; 66/9 B

[56] References Cited

U.S. PATENT DOCUMENTS

| | | | |
|---|---|---|---|
| 1,547,950 | 7/1925 | Oger | 19/114 |
| 3,188,834 | 6/1965 | Radtke | 66/9 B |
| 3,928,986 | 12/1975 | Thore | 66/9 B |

FOREIGN PATENT DOCUMENTS

| | | | |
|---|---|---|---|
| 918677 | 9/1954 | Fed. Rep. of Germany | 19/112 |
| 13491 | of 1851 | United Kingdom | 19/112 |
| 2074 | of 1877 | United Kingdom | 19/112 |
| 4374 | of 1877 | United Kingdom | 19/112 |
| 1967 | of 1878 | United Kingdom | 19/112 |
| 222342 | 10/1924 | United Kingdom | 19/112 |
| 503019 | 3/1939 | United Kingdom | 19/112 |

*Primary Examiner*—Wm. Carter Reynolds

*Attorney, Agent, or Firm*—Nathan Levin

[57] ABSTRACT

Improvement in sliver feeding devices for use with circular knitting machines to make sliver knitted fabric, wherein the device has comber and doffer drums each of which is covered with spirally extending wrappings of card wire cloths, wherein the wrappings on the doffer drum comprises a single individual card wire cloth extending in a single spiral, and wherein the wrappings on the comber drum comprise a plurality of individual card wire cloths extending in a plural spiral.

1 Claim, 8 Drawing Figures

CARDING DRUM FOR HIGH PILE CIRCULAR KNITTING MACHINES

Figure 1:
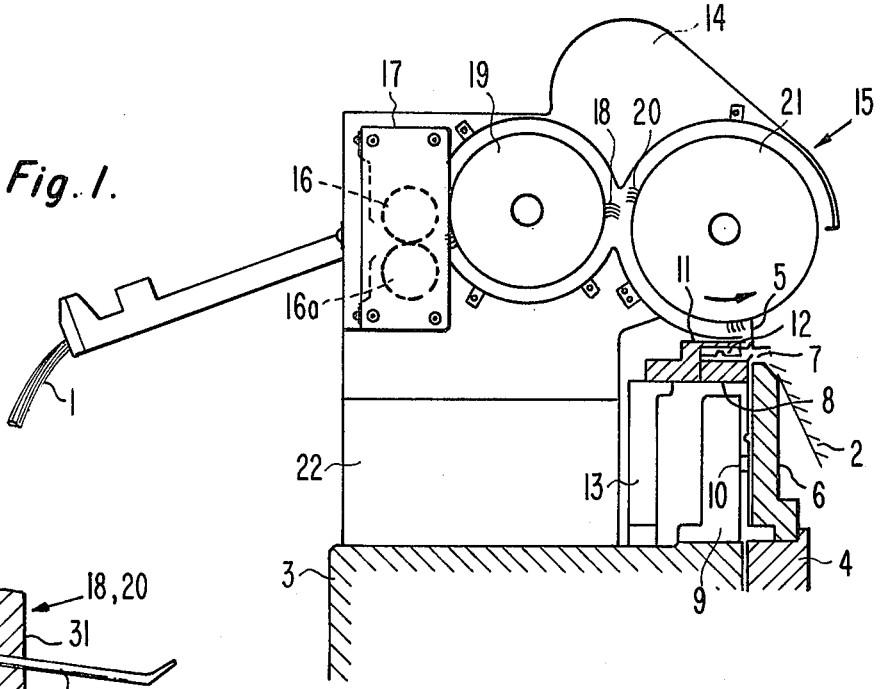

The present invention relates generally to the art of knitting and more particularly to an improved device to feed sliver to the needles of circular knitting machines for the making of sliver knitted fabric thereon, the improved device providing for more equal distribution and more uniform feeding of the sliver to the needles whereby the quality of the fabric being made is improved. The device is of the type having comber and doffer drums and wherein the improvement is in the structure of the comber drum.

The conventional type of sliver feeding device is provided with rollers to feed sliver to the comber drum which acts upon and transfers the sliver to the doffer drum in a first transfer zone and from which the needles take the sliver in a second transfer zone. Conventionally the comber and doffer drums are each similarly covered with spiral wrappings of single individual strips of relatively long and narrow card wire cloths of uniform width which are arranged in single spirals about the periphery of the drums. The card cloth has resilient hook-like wires extending individually from one face thereof in a plurality of spaced lengthwise extending parallel rows with the wire hooks spaced in each row and in staggered relation to the wire hooks in adjoining rows. With the single spiral arrangement of the cloths on the drums, each row of the hooks about a drum extends generally normal to the axis of the drum, except for a slight variation caused by the spiral arrangement of the cloths, such variation being negligable so far as action by the hooks upon the sliver is concerned. The hooks in each circle thereof about the drum continues to plow the same furrow in the sliver as the drum rotates. The more hooks extending crosswise of the drum the more the sliver is carded. The distances between such furrows is equal to the distances between the rows of hooks and the number of the furrows is equal to the number of rows of hooks. When the sliver feeding device is used upon a knitting machine having a needle selecting apparatus, selected ones of the needles take sliver from the doffer drum.

When using the conventional sliver feeding device upon a circular knitting machine it happens that there is not always sufficient sliver available on the doffer for all of the selected needles, as may result from an uneven distribution of the sliver on the doffer, which in turn may result from an uneven distribution of the sliver on the comber. The uneven distribution of the sliver on the comber may result from insufficient carding thereof. The uneven distribution results in the making of knitted sliver fabric of inferior quality.

It is extremely difficult to provide sliver in the exact amount needed at all times by the needles and while a variety of ideas have been suggested for the sliver feeding devices, no device has been found to be satisfactory. It has been suggested that use be made of a mixture of yarn staples differing in length and size, and while this is an improvement, it is not entirely satisfactory. In the case when it is desired to use sliver made up of fine and short staples of a single kind to make a particular type of fabric, the conventional sliver feeding device is not satisfactory and the quality of the fabric made therewith is not acceptable.

The present invention overcomes the feeding problem of the conventional sliver feeding device by providing an improved comber drum wherein its wrappings comprise a plurality of individual card wire cloths arranged to form a plural spiral thereof on the periphery of the drum. As a result the angle of the rows of hooks is changed relative to the axis of the drum so that more hooks are available to plow more furrows in the sliver and thus to more uniformly distribute the sliver on the comber drum for transfer to the doffer drum and to the needles. While the number of furrows is increased, the distances between them is decreased and the sliver is subjected to more carding action thereon.

With the above and other objects in view as will become apparent from the accompanying drawings and the description thereof, the invention resides in the improvement in sliver feeding devices for circular knitting machines as shown and as described, and as set forth in the appended claims.

Figure 5:
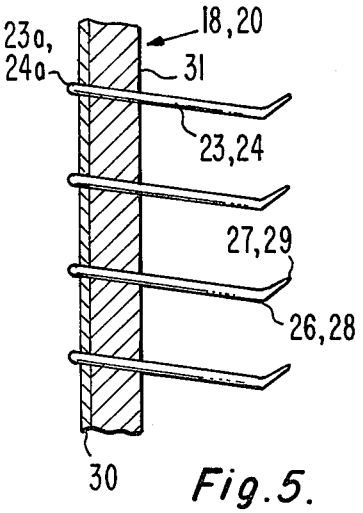
Figure 4:
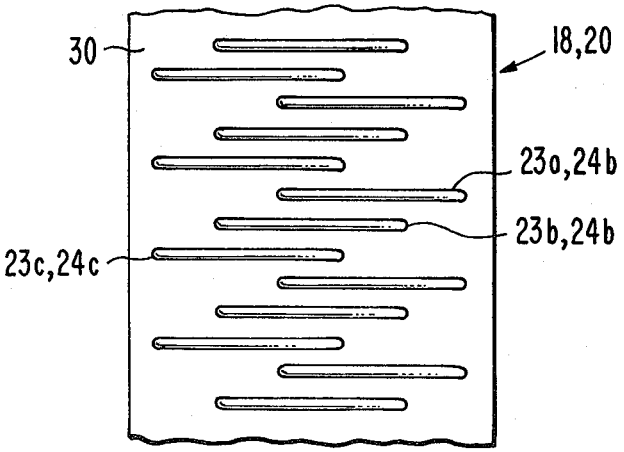
Figure 3:
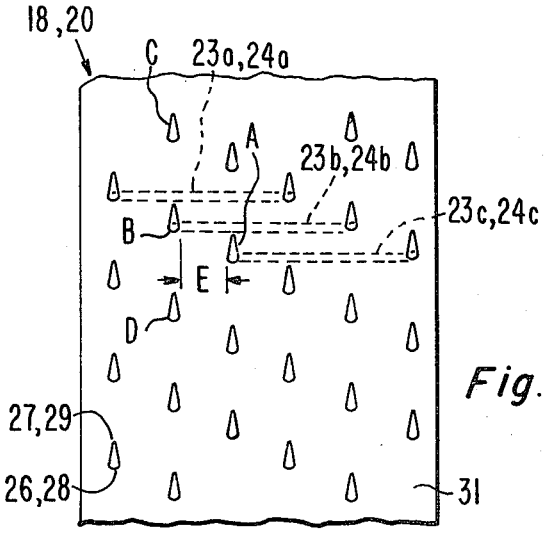
Figure 2:
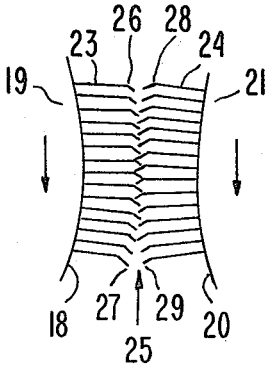
Figure 6:
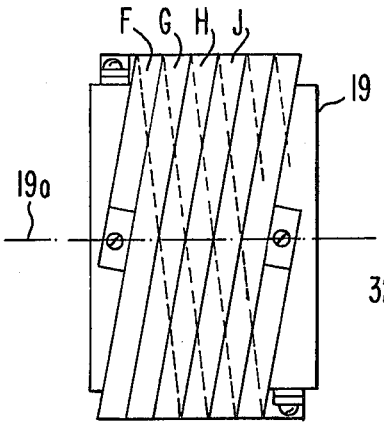
Figure 7:
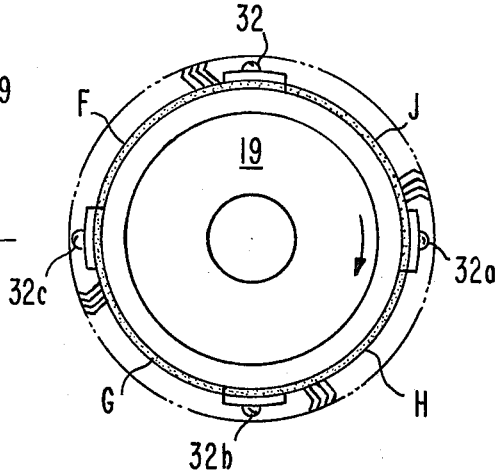
Figure 8:
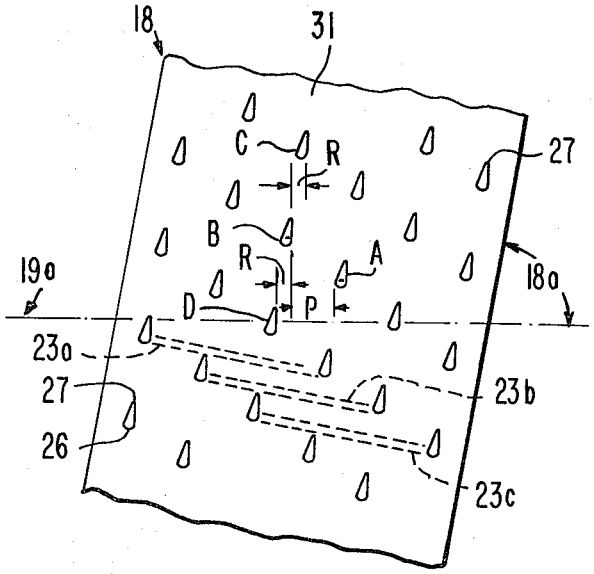

In the drawings:

FIG. 1 is a side view, partly in section, showing relevant portions of a circular knitting machine equipped with the improved sliver feeding device of the present invention for the production of sliver knitted fabric, the device having rollers to feed the sliver to a comber drum, and a doffer drum to take the sliver from the comber drum and from which the sliver is taken by the needles of the machine, FIG. 2 is a schematic view showing interaction between the card wire hooks of the pair of comber and doffer drums as the sliver is transferred therebetween, FIGS. 3, 4 and 5 are views showing the face side, the reverse side and a cross-section, respectively, of tape-like card wire cloths which are spirally wound in abutting relation about the periphery of the drums, FIG. 6 is a side view of the improved comber drum showing a plurality of similar card cloths wound in abutting relation about the same in a plural spiral, FIG. 7 is an end view of FIG. 6 showing the spacing between the points of attachment of the cloths to the drum, and FIG. 8 is a view generally similar to FIG. 3 with a card cloth extending at the angle of the plural spiral of the cloths on the comber drum.

In the drawings, FIG. 1 is a view showing relevant parts of a circular knitting machine which is equipped with the sliver feeding device 15 of the present invention and upon which sliver knitted fabric 2 is made by knitting sliver 1 and a body yarn. The machine has a rotary cylinder 6 with needles 5 therein and a rotary sinker bed 8 with sinkers 7 therein, the needles being operated by cams 10 affixed to a cam ring 9 while the sinkers are operated by cams 12 affixed to a sinker cap 11. The cylinder and the sinker bed are affixed to and rotate with gear ring 4 on frame 3. The sinker cap is supported by a number of brackets 13 secured to the frame.

The sliver feeding device 15 is fixed to card holder 14 and comprises a sliver feeder 17 in which a pair of rollers 16, **16*a* take the sliver 1, compress and feed it to a first comber drum 19 covered with card cloth 18, and a second doffer drum 21 covered with card cloth 20, to which the sliver is transferred from the comber drum and from which the sliver is transferred to needles which have been selected to knit the same. Feed rollers 16, 16*a*, comber drum 19, doffer drum 21, and gear ring 4 are driven in the usual manner, not shown, from driving means 22**.

As appears in FIG. 2, wires 23, bent at 26 and having tips 27 project individually from cloth 18 on comber drum 19, while wires 24, bent at 28 and having tips 29 project individually from cloth 20 on doffer drum 21. The drums rotate in opposite directions as shown and the wires of both drums are so bent at 26, 28 that their ends 27, 29 extend forwardly in the direction of rotation of the drums. The wires of both drums are resilient and intermesh in a zone 25 in which the sliver is transferred from the wires of cloth 18 of the comber drum to the wires of cloth 20 of the doffer drum as the drums turn.

The cloths 18, 20, FIGS. 3, 4, 5, in tape-like strips of indefinite length and of 6 to 10 mm in width, are made of a cotton backing fabric 30 laminated with sponge rubber 31, or the like, and U-shaped carding wires 23, 24 extending through the cloths from the cotton side thereof. The wires are arranged in repeats of equally spaced stepwise rows of three to five carding wires, three being shown here as at 23*a*, 24*a*, 23*b*, 24*b* and 23*c*, 24*c*. The hooks 23, 24 are spaced in each of a plurality of parallel rows with the hooks in each row staggered in relation to the hooks in adjoining rows. Thus in cloth 20, which is spirally wrapped in abutting relation around the doffer drum in a single spiral, the transverse distance between carding wire hook A and the row of carding wires B, C and D is shown at E. The distance between the rows is slightly shortened with respect to the direction of drum rotation due to the spiral winding of the cloth, and in which the wires, such as B, C and D each follows its own path. There are six rows of card hooks acting upon the sliver to form six furrows therein as the sliver is being carded.

As shown in FIGS. 6, 7 and 8, there are four strips of card wire cloth F, G, H and J, each similar to cloth 18, which are spirally wound in abutting relation around comber drum 19 in a quadruple spiral, with each cloth starting at equally circumferentially spaced points, indicated by holding screws 32, 32*a*, 32*b* and 32*c*, around the periphery of the drum. As a result each cloth is at an angle 18*a* of the plural spiral with respect to axis 19*a*. The angle is much greater than in the case wherein a single strip of cloth is wound around the drum in a single spiral. It will be seen that wires C and D are each staggered with respect to wire B by a distance R which may be within a range of half to twice the diameter of the wire itself even though wires C, D and B are in the same row. The result is to provide more hooks effective transversely of the drum to act upon and to card the sliver. Further, the distance P between hooks A, B, of separate rows, is now less than the distance E of FIG. 3. The action of the additional wire hooks extending crosswise of the drum, serves to more uniformly distribute the sliver on the comber drum for transfer to the doffer drum and to the needles of the machine.

It will be understood that the number of card wire cloths on the comber drum is not limited to the four cloths shown, and that the doffer and other like drums may also be provided with spiral wrappings of a plurality of card wire cloths. In the example shown the plurality of card wire cloths on the comber drum extends at a steeper spiral angle than does the corresponding single card wire cloth on the doffer drum.

What is claimed is:

1. Improvement in a sliver feeding device to feed sliver to the circle of latch needles of a circular knitting machine, the device being of the type having a comber and a doffer drum which act upon the sliver to transfer the sliver from the comber to the doffer drum and then to transfer the sliver from the doffer drum to the needles, the drums being of the type which are covered with spirally wound wrappings of card wire cloth, and the improvement in such device wherein the wrappings on the comber drum are composed of at least three individual card wire cloths arranged to form a multiple spiral thereof and wherein the wrappings on the doffer drum are comprised of a single individual card wire cloth arranged to form a single spiral thereof.

* * * * *